US005111868A

United States Patent [19]

Sawaya

[11] Patent Number: 5,111,868

[45] Date of Patent: May 12, 1992

[54] REPLACEMENT EYELET FOR FLEXIBLE CURTAINS

[76] Inventor: Frederick J. Sawaya, 5631 Farmington Rd., West Bloomfield, Mich. 48322

[21] Appl. No.: 724,677

[22] Filed: Jul. 2, 1991

[51] Int. Cl.[5] ..... A47K 3/24; A47H 1/00

[52] U.S. Cl. ..... 160/330; 4/608; 16/87.2

[58] Field of Search ..... 160/330, DIG. 6; 16/87.2, 108; 4/608, 610; 402/79

[56] References Cited

U.S. PATENT DOCUMENTS

| | | | |
|---|---|---|---|
| 579,912 | 3/1897 | Woolf | 16/87.2 |
| 1,447,126 | 2/1923 | Dwyer | 16/87.2 |
| 2,069,600 | 2/1937 | Coleman | 160/330 |
| 2,601,125 | 6/1952 | O'Connor | 402/79 |
| 2,831,538 | 4/1958 | Lishman | 402/79 X |
| 3,737,943 | 6/1973 | Störe | 16/87.2 |
| 3,772,734 | 11/1973 | Kimel | 16/87.2 |
| 4,010,503 | 3/1977 | Denton | 16/87.2 |
| 4,120,343 | 10/1978 | Wilson | 160/330 |
| 4,431,325 | 2/1984 | Colby | 402/79 |
| 4,688,620 | 8/1987 | Lechner et al. | 16/87.2 X |

FOREIGN PATENT DOCUMENTS

| | | | |
|---|---|---|---|
| 634105 | 7/1934 | Fed. Rep. of Germany | 402/79 |
| 347314 | 6/1960 | Switzerland | 16/87.2 |

*Primary Examiner*—Carl D. Friedman
*Assistant Examiner*—Derek J. Berger
*Attorney, Agent, or Firm*—Dykema Gossett

[57] ABSTRACT

An improved method and apparatus for reinforcing holes in a curtain is disclosed. A reinforcement member is positioned over the hole and has a cutting element which cuts through the curtain. The cutting element locks the reinforcement member about the hole, reinforcing the hole. This invention is particularly valuable if the hole has been ripped.

3 Claims, 1 Drawing Sheet

REPLACEMENT EYELET FOR FLEXIBLE CURTAINS

BACKGROUND OF THE INVENTION

This invention is directed to a unique method and apparatus for reinforcing and repairing curtain holes.

Curtains have been disposed to cover various areas in the prior art, and are mounted in various ways. In particular, shower curtains or sheets are often mounted with rings passing through a plurality of spaced holes in the shower curtain, with the rings supported on a rod. The curtain may be adjusted between open and closed positions by moving the rings along the rods. Such systems are widely used in the prior art.

Problems arise with such systems, however, because the curtains or sheets are often formed from relatively inexpensive plastic material. The holes for the rings are formed near a top edge of the sheet, and may rip to the end of the sheet. When this happens the rings will no longer support the sheet through the particular ripped or torn holes.

It is an object of the present invention to disclose a system for reinforcing the sheets in the area of the ring holes, and further to repair torn holes.

SUMMARY OF THE INVENTION

A method for repairing or reinforcing holes in a curtain comprises the step of placing a reinforcement member over the hole, and then placing a support member for supporting the curtain through the reinforced hole. More particularly, the reinforcement member has a cutting element which cuts through the curtain to secure the reinforcement member about the hole. Even more preferably, there are a plurality of such reinforcement members on a plurality of holes. In one embodiment hooks extend through the holes and the hooks are supported on an elongated rod.

An apparatus according to the present invention includes a reinforcement member for reinforcing or repairing a hole in a curtain. The reinforcement member or element is formed of two adjacent planar sides with an intermediate hinge. Each side has an aperture extending through its center which is aligned with the hole in the curtain. The reinforcement element preferably has a cutting element at the end of the side remote from the hinge and the other side has a safety cap which receives the cutting element.

The reinforcement element is placed with its hinge adjacent the top end or edge of the curtain, and with side central apertures aligned with the hole in the curtain. The sides are then pivoted towards each other. The cutting element is pushed through the curtain and into the safety cap. The cutting element thus extends beyond an opposed side when secured on the curtain.

These and other features of the present invention can be best understood from the following specification and drawings, of which the following is a brief description.

DETAILED DESCRIPTION OF A PREFERRED EMBODIMENT

Figure 1:
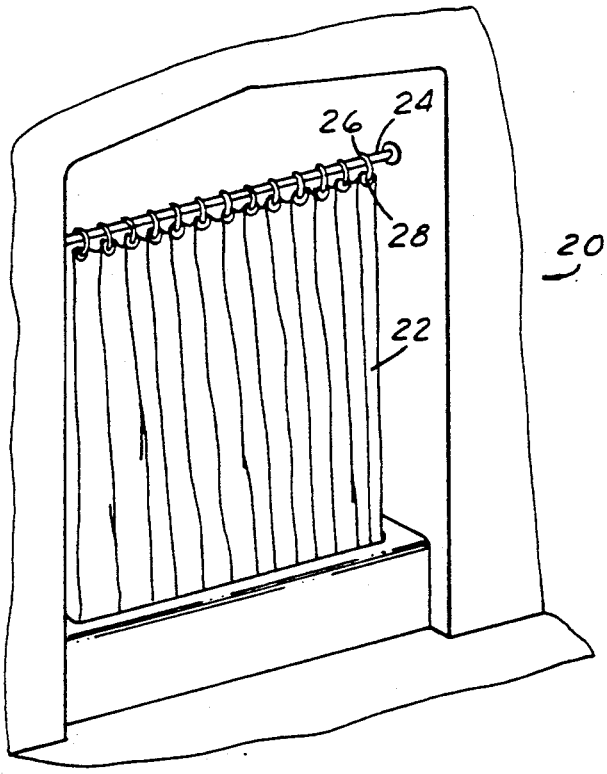
FIG. 1 is a perspective view of a shower assembly having a curtain in a supported position.
Figure 1A:
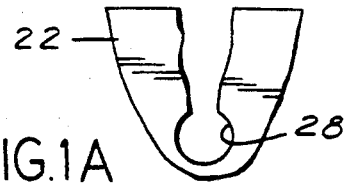
FIG. 1A is a fragmentary elevational view of a curtain with a torn curtain hole.

A shower assembly 20 may include a shower curtain or curtain member 22, which is typically formed of a flexible plastic sheet material. Rod 24 supports a plurality of rings or hooks 26 which extend through holes 28 in curtain 22. Curtain 22 slides upon rod support 24 with rings 26 moving along the rod. From time to time, the holes 28 in the curtain 22 may tear, such as shown in FIG. 1A, such that a ring 26 will no longer support that particular hole. A novel reinforcement member 30 is attached to the hole 28 according to the method and apparatus of this invention.

Figure 2:
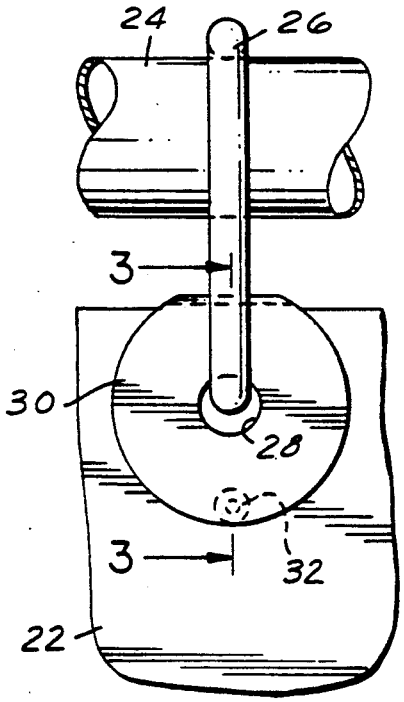
FIG. 2 is an enlarged fragmentary view of a shower curtain illustrating the manner of support from the rod.

As shown in FIG. 2, ring 26 extends through hole 28 in curtain 22. A reinforcement member or replacement eyelet 30 surrounds hole 28, preventing ring 26 from ripping through curtain 22. A cutting element 32 secures reinforcement member 30 to curtain 22.

Figure 3:
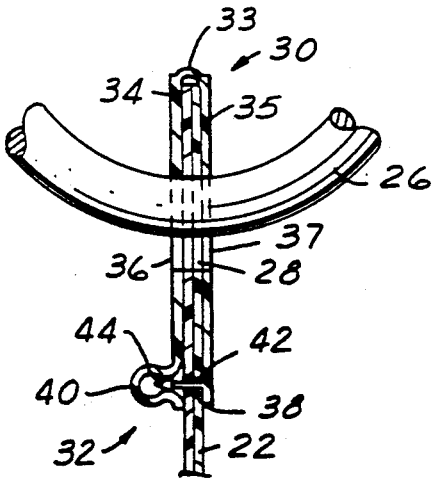
FIG. 3 is a cross-sectional view along line 3—3 as shown in FIG. 2.

As shown in FIG. 3, reinforcement member 30 may include a live and flexible hinge 33 which connects two sides 34 and 35. Side 34 has an aperture 36 and side 35 has an aperture 37. Apertures 36 and 37 are preferably aligned with hole 28 in curtain member 22 such that ring or hook 26 may extend through the three aligned apertures. Cutting member or arrow 38 extends through the curtain 22 into safety cap 40. When cutting element or arrow 38 carried by side 35 moves through curtain 22 it creates a hole or aperture 42. In this secured position cutting element 38 extends beyond side 34.

Cutting element 38 has a winged or enlarged head 44 which flexes inwardly when moving through curtain 22, and which is biased outwardly away once it extends through aperture 42. This minimizes the size of hole 42, and also ensures the cutting element 38 will not move back through hole 42.

Figure 4:
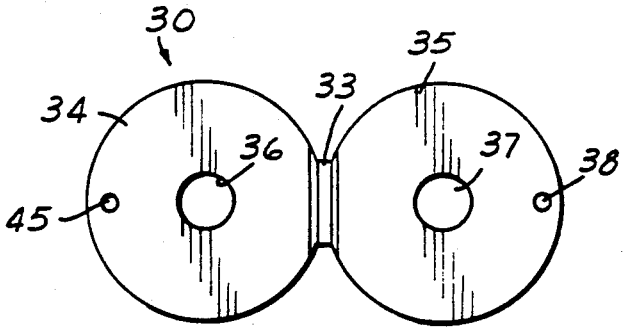
FIG. 4 is a plan view of a reinforcement member constructed according to the present invention.

As shown in FIG. 4, reinforcement member 30 includes hinge a line 33 connecting sides 34 and 35. Cutting element 38 extends through an aperture 45 in an inner face of side 34 which leads into safety cap 40.

Figure 5:
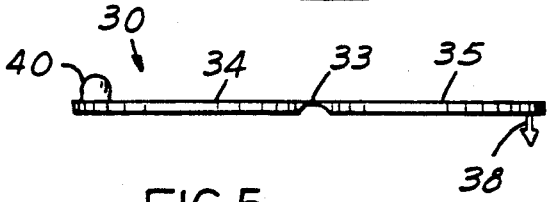
FIG. 5 is a side view of the reinforcement member illustrated in FIG. 4.

As shown in FIG. 5, reinforcement member 30 has safety cap 40 on an outer face of side 34. Cutting element 38 is formed on an opposed face of side 35.

Reinforcement member 30 is preferably placed over a ripped or torn hole 28, although it can also be used to reinforce unripped holes 28. The reinforcement element 30 is of unitary construction and is preferably formed of a suitable resilient plastic material. As an alternative to the cutting structure, the reinforcement element 30 may use other securing means such as tape or other adhesives to secure the reinforcement member to the curtain member.

From reviewing the drawings and specifications it is apparent that the reinforcement member or replacement eyelet may be used not only with a plastic shower curtain but also with cloth, paper, rubber or plastic curtains used for any purpose and having eyelets. As an example the novel replacement eyelets may be used with movie drapes, stage drapes, truck mud flaps or curtains, ocean tarps tarpaulins, soils for boats, canvas tarps used for athletic events to name a few.

A preferred embodiment of this invention has been disclosed, however, a worker of ordinary skill in the art would recognize that certain modifications would come within the scope of this invention. For that reason the following claims should be studied in order to determine the true scope and content of this invention.

I claim:

1. A shower curtain comprising:

a generally planar rectangular curtain member, said curtain member having a plurality of holes adjacent one edge thereof, there being a small distance between said holes and said adjacent one edge;

reinforcement members being received about said holes, said reinforcement members having respective apertures aligned with said holes in said curtain member, said reinforcement members having portions received in said small distance to reinforce said curtain member along said small distance, and said reinforcement members having integral cutting elements cutting through said curtain member to secure said reinforcement members to said curtain member, said reinforcement members formed of two generally planar sides connected by a hinge, one of said planar sides having said cutting elements for extending through said curtain member, the other of said planar sides having an integral cap for receiving said cutting elements, said hinge being received outwardly of one end of said planar side, said cutting elements extending through said planar side having said cap and into said cap, said cap being formed on an opposed face of said planar side removed from said cutting element.

2. A curtain as recited in claim 1, wherein said cutting element is flexible, and has a winged head which flexes inwardly when forming an aperture in said curtain member, and which moves outwardly after having moved through the curtain member, and is received in said cap.

3. The curtain as recited in claim 1, wherein there are a plurality of said holes and said cutting elements.

* * * * *